US005694004A

United States Patent [19]

Kimiya et al.

[11] Patent Number: 5,694,004

[45] Date of Patent: Dec. 2, 1997

[54] COLOR CATHODE RAY TUBE APPARATUS

[75] Inventors: Junichi Kimiya, Fukaya; Shigeru Sugawara, Saitama-ken; Eiji Kamohara; Kumio Fukuda, both of Fukaya, all of Japan

[73] Assignee: Kabushiki Kaisha Toshiba, Kawasaki, Japan

[21] Appl. No.: 756,932

[22] Filed: Dec. 2, 1996

Related U.S. Application Data

[63] Continuation of Ser. No. 314,623, Sep. 29, 1994, abandoned.

[30] Foreign Application Priority Data

Sep. 30, 1993 [JP] Japan ..... 5-243476
Sep. 8, 1994 [JP] Japan ..... 6-214366

[51] Int. Cl.[6] ..... H01J 29/46

[52] U.S. Cl. ..... 315/15; 315/17; 315/382.1; 313/412; 313/414; 313/432; 313/439

[58] Field of Search ..... 313/412, 414, 313/415, 428, 432, 439, 446; 315/368.15, 382, 382.1, 15, 17

[56] References Cited

U.S. PATENT DOCUMENTS

| | | | |
|---|---|---|---|
| 4,558,253 | 12/1985 | Bechis et al. | 313/414 |
| 4,701,677 | 10/1987 | Ashizaki et al. | 313/414 X |
| 4,825,120 | 4/1989 | Takahashi | 313/414 |
| 4,890,032 | 12/1989 | Bijima et al. | 313/414 X |
| 4,897,575 | 1/1990 | Shimoma et al. | 315/15 |
| 4,935,663 | 6/1990 | Shimoma et al. | 313/414 X |
| 5,142,190 | 8/1992 | Koh | 313/414 |
| 5,291,094 | 3/1994 | Lee | 313/414 |
| 5,384,512 | 1/1995 | Kamohara et al. | 313/414 |
| 5,404,071 | 4/1995 | Son | 313/414 |

FOREIGN PATENT DOCUMENTS

| | | |
|---|---|---|
| 0 275 191 | 7/1988 | European Pat. Off. . |
| 4 43532 | 2/1992 | Japan . |
| 2 034 516 | 6/1980 | United Kingdom . |
| 2 236 613 | 4/1991 | United Kingdom . |

*Primary Examiner*—Ashok Patel
*Attorney, Agent, or Firm*—Cushman, Darby & Cushman IP Group of Pillsbury Madison & Sutro LLP

[57] ABSTRACT

In a color cathode ray tube apparatus, a main electron lens unit for converging three in-line electron beams on a phosphor screen is formed of a plurality of electrodes, including at least first, second, and third electrodes, which are arranged from the cathode side toward the phosphor screen. An asymmetric electron lens, which horizontally diverges and vertically converges the electron beams, is formed on the cathode side in a lens effect region of a first electron lens composed of the second and third electrodes, and an asymmetric second electron lens, which has one effect with respect to the horizontal direction of the electron beams and another with respect to the vertical direction, is formed between the first and second electrodes, at the least. In this arrangement, the effects of the second lens to converge and diverge the electron beams in the horizontal and vertical directions, respectively, are enhanced, and the effects of the first electron lens are attenuated, depending on the deflection of the electron beams by means of a deflection yoke. Thus, the horizontal and vertical diameters of beam spots at the peripheral portion of a picture can be reduced.

4 Claims, 7 Drawing Sheets

COLOR CATHODE RAY TUBE APPARATUS

This is a continuation of U.S. application Ser. No. 08/314,623, filed on Sep. 29, 1994, now abandoned.

BACKGROUND OF THE INVENTION

1. Field of the Invention

The present invention relates to a color cathode ray tube apparatus, and more particularly, to a cathode ray tube apparatus using a dynamic-focus system for correcting deflective aberration which is caused by a magnetic field generated by means of a deflection yoke.

2. Description of the Related Art

In general, a color cathode ray tube apparatus comprises an envelope which is composed of a panel 1 and a funnel 2 bonded integrally to the panel, as shown in FIG. 1. Formed on the inner surface of the panel 1 is a phosphor screen 3, composed of three stripe- or dot-shaped phosphor layers of different colors which emit blue, green, and red light beams. A shadow mask 4, having a number of electron beam holes therein, is attached to the inside of the phosphor screen 3 so as to face it. Located in a neck 5 of the funnel 2 is an electron gun assembly 7 for emitting three electron beams 6B, 6G and 6R. The electron beams 6B, 6G and 6R emitted from the electron gun assembly 7 are deflected by means of horizontal and vertical deflecting magnetic fields, which are generated from a deflection yoke 8 attached to the outside of the funnel 2, and land on the phosphor screen 3 through the shadow mask 4. As the screen 3 is scanned horizontally and vertically, a color image is displayed thereon.

As the currently prevailing apparatus constructed in this manner, there is a color cathode ray tube apparatus of the self-convergence in-line type in which the electron gun assembly 7, in particular, is formed of an in-line assembly for emitting three in-line electron beams including a center beam 6G and a pair of side beams 6B and 6R which pass along one horizontal plane. In this apparatus, moreover, the horizontal and vertical deflecting magnetic fields generated from the deflection yoke 8 are pincushion-shaped and barrel-shaped, respectively, so that the three in-line electron beams 6B, 6G and 6R can be concentrated on the whole surface of the phosphor screen 3 by means of the irregularly shaped magnetic fields.

In this self-convergence, in-line apparatus, however, beam spots **10*b* at the peripheral portion of a picture are distorted under the influence of deflective aberration, i.e. astigmatism aberration, of the deflecting magnetic fields, so that the resolution of the peripheral portion of the picture is lowered, although each beam spot 10*a* at the central portion of the picture has the shape of a perfectly round circle. Thus, even though the beam spot 10*a* is shaped like a circle, as shown in the graph of FIG. 2A of which the origin of the coordinate axes is on the center of the screen, the beam spots are each distorted into a configuration combining a horizontally elongated high-brightness core portion 11 and low-brightness halo portions 12 on the upper and lower sides thereof, as shown in FIGS. 2B and 2C**, around a D-axis in the diagonal direction of the picture and an H-axis in the horizontal direction.

This is because the irregular deflecting magnetic fields serve as an equivalent quadruple lens acting on the electron beams in a manner such that the electron beams focus in the vertical direction and diverge in the horizontal direction, and the electron beams on the screen are subjected to astigmatism such that they are in an excessively focused state with respect to the vertical direction and in an insufficiently focused state with respect to the horizontal direction. In the peripheral portion of the picture, moreover, the electron beams are obliquely incident upon the screen, so that they are subject to a geometrical distortion which results in horizontally elongated beam spots.

In order to prevent lowering of the resolution due to the deflective aberration, a high-performance electron gun assembly has been developed. According to this gun assembly, the deflective aberration at the peripheral portion of the picture is corrected by changing the lens effect of some of the electron lenses which constitute the assembly as the electron beams are deflected toward the peripheral portion.

An example of the electron gun assembly of this type is described in Jpn. Pat. Appln. KOKAI Publication No. 64-38947 (U.S. Pat. No. 4,897,575). In this case, a dynamic-focus voltage is applied to some of the electrodes which constitute a main electron lens unit so that two quadruple lenses with different effects are formed in the main lens unit. As shown in FIG. 3A, this electron gun assembly includes three in-line cathodes KR, KG and KB, three heaters (not shown) for individually heating the cathodes, and first to fifth grids G1 to G5 successively arranged at regular intervals from the cathodes toward a phosphor screen, two intermediate electrodes GM1 and GM2, and a sixth grid G6. The fifth grid G5 has three through holes, at a side of the intermediate electrode GM1, for allowing the three electron beams to pass therethrough, respectively, each of the electron beam through holes being so formed as to be elongated in the horizontal direction, i.e., the in-line direction, as shown in FIG. 3B. Each of the intermediate electrodes GM1, GM2 has three circular through holes for allowing the three electron beams to pass therethrough, respectively, as shown in FIG. 3C, and the sixth grid also has three through holes, at a side of the intermediate electrode GM2, for allowing the three electron beams to pass therethrough, respectively, each of the electron beam through holes being so formed as to be elongated in the horizontal direction, i.e., the in-line direction, as shown in FIG. 3D. The fifth grid G5 is supplied with a dynamic-focus voltage obtained by superposing a fluctuating voltage Vd, which varies depending on the deflection of the electron beams, on a predetermined DC voltage.

FIG. 4 shows voltages applied to the electrodes G3 to G6. As voltages are applied in this electron gun assembly, a main electron lens unit ML of the extended electric field type is formed between the fifth and sixth grids G5 and G6, as shown in FIG. 5A. The lens unit ML includes a quadruple lens QL2, which is formed of the fifth grid G5 and the intermediate electrode GM1 adjacent thereto and has effects of divergence in the horizontal direction (H) and focusing in the vertical direction (V), a cylindrical lens CL formed between the intermediate electrode GM1, GM2 and another quadruple lens QL1, which is formed of the intermediate electrode GM2 and the sixth grid G6 adjacent thereto and has effects of focusing in the horizontal direction (H) and divergence in the vertical direction (V). In this electron gun assembly, the voltage applied to the fifth grid G5 is increased from the level indicated by the solid line to the level indicated by the broken line, as shown in FIG. 4, as the three electron beams are deflected toward the peripheral portion of the picture. Thus, the combined lens power of the quadruple lens QL2 and cylindrical lens is weakened so that it has relative effects of divergence in the vertical direction (V) and focusing in the horizontal direction (H), as shown in FIG. 5A, whereby the focusing effect of the whole main electron lens unit ML is attenuated. As a result, the effect of divergence for the electron beams in the vertical direction (V) is enhanced, as indicated by the broken line in FIG. 5B. With respect to the horizontal direction (H), the focusing effect of the whole main electron lens unit ML is attenuated, although that of the lens QL2 is enhanced, so that there is no substantial change as a whole. Accordingly, the excessive focusing of the electron beams in the vertical direction (V) caused by the irregular deflecting magnetic fields is corrected as the electron beams are diverged in the vertical direction (V) by means of the electron gun assembly. As shown in FIGS. 2D and 2E, therefore, the distortion of the vertical diameter of the beam spots **10*b*** at the peripheral portion of the picture is removed. Since the state of focusing of the electron beams with respect to the horizontal direction (H) hardly makes any change on the assembly side, the horizontally elongated distortion of the beam spots at the peripheral portion of the picture can hardly be eliminated. This is so because there still remain the effects of divergence which the electron beams horizontally receive from the equivalent quadruple lens of the deflecting magnetic field and the geometrical distortion of the spots attributable to the oblique incidence of the electron beams upon the screen.

Thus, a high-resolution color cathode ray tube apparatus cannot be successfully constructed with use of the electron gun assembly of this type. In order to correct the deflective distortion of the beam spots **10*b*** at the peripheral portion of the picture, moreover, this electron gun assembly requires use of high voltages, and entails some economical disadvantages, such as power loss including loss of dielectric strength.

If the horizontal and vertical deflecting magnetic fields generated from the deflection yoke are pincushion-shaped and barrel-shaped, respectively, in order that the three in-line electron beams emitted from the electron gun assembly and passing along the same horizontal plane can be concentrated on the whole surface of the phosphor screen, as described above, the electron beams are subjected to the influence of the deflective aberration of the deflecting magnetic fields and the geometrical distortion attributable to their oblique incidence upon the screen. Thereupon, the beam spots at the peripheral portion of the picture are distorted, so that the resolution of the picture is lowered considerably.

In order to prevent the resolution from being lowered by the deflective aberration described above, an electron gun assembly is designed so that two intermediate electrodes are arranged between fifth and sixth grids, and a dynamic-focus voltage is applied to the fifth grid to form a main electron lens between the fifth and sixth grids. The main electron lens includes two quadruple lenses having effects of divergence and focusing in the horizontal and vertical directions, respectively, and another quadruple lens having effects of focusing and divergence in the horizontal and vertical directions, respectively.

In this electron gun assembly, the dynamic-focus voltage applied to the fifth grid is increased as the three electron beams are deflected toward the peripheral portion of the picture, whereby the power of the quadruple lens which has the effects of divergence and focusing in the horizontal and vertical directions, respectively, can be attenuated to weaken the main electron lens equivalently and enhance the vertical diverging effect. However, the horizontal focusing effect hardly changes.

Although the vertical diameter of the beam spots **10*b*** at the peripheral portion of the picture is improved, the horizontal diameter hardly changes, so that a high-resolution color cathode ray tube apparatus cannot be constructed. In order to remove the deflective distortion of the beam spots at the peripheral portion of the picture, moreover, this electron gun assembly requires use of high voltages, and entails some economical disadvantages, such as power loss including loss of dielectric strength.

SUMMARY OF THE INVENTION

An object of the present invention is to provide a color cathode ray tube apparatus with high resolution, capable of improving the horizontal diameter of beam spots at the peripheral portion of a picture, correcting a deflective distortion with use of a low dynamic-focus voltage, and forming small beam spots over the whole area of the picture.

According to the present invention, there is provided a color cathode ray tube apparatus which comprises an electron gun assembly, including an electron beam generating unit formed of a plurality of electrodes including cathodes and generating three in-line electron beams, and a main electron lens unit formed of a plurality of electrodes and focusing the electron beams on a phosphor screen, and a deflection yoke for deflecting the electron beams from the electron gun assembly in the horizontal and vertical directions. The main electron lens unit includes at least first, second, and third electrodes, which are arranged from the cathode side toward the phosphor screen. An asymmetric electron lens, which horizontally diverges and vertically focuses the electron beams, is formed on the cathode side in a lens effect region of a first electron lens composed of the second and third electrodes, and an asymmetric second electron lens, which has one effect with respect to the horizontal direction of the electron beams and another with respect to the vertical direction, is formed between the first and second electrodes, at the least. In this arrangement, the effects of the second lens to focus and diverge the electron beams in the horizontal and vertical directions, respectively, are enhanced, and the effects of the first electron lens are attenuated, depending on the deflection of the electron beams by means of the deflection yoke.

With use of the main electron lens unit constructed in this manner, the effects of the first electron lens are attenuated, and the asymmetric second electron lens is caused to act, depending on the deflection of the electron beams. Thus, the electron beams are diverged in the vertical direction in two stages by means of the first and second electron lenses, whereby excessive focusing caused by deflecting magnetic fields is corrected. At the same time, the electron beams are focused or constricted in the horizontal direction before they are landed on the first electron lens, whereby the electron beams passing through the deflecting magnetic fields are excessively focused to have a small horizontal diameter. By doing this, the effect of divergence of the deflecting magnetic fields and a geometrical distortion of the electron beams, obliquely incident upon the screen, can be corrected. By supplying the second electrode with a voltage which varies depending on the deflection of the electron beams, moreover, it is possible to provide two electron lenses which substantially have effects of focusing and divergence in the horizontal and vertical directions, respectively. Thus, in contrast with the conventional case where only one electrode is used in one stage to produce the effects of focusing and divergence in the horizontal and vertical directions, respectively, a distortion of beam spots at the peripheral portion of the picture can be corrected with use of a low dynamic-focus voltage.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Preferred embodiments of a color cathode ray tube apparatus according to the present invention will now be described with reference to the accompanying drawings.

Figure 6:
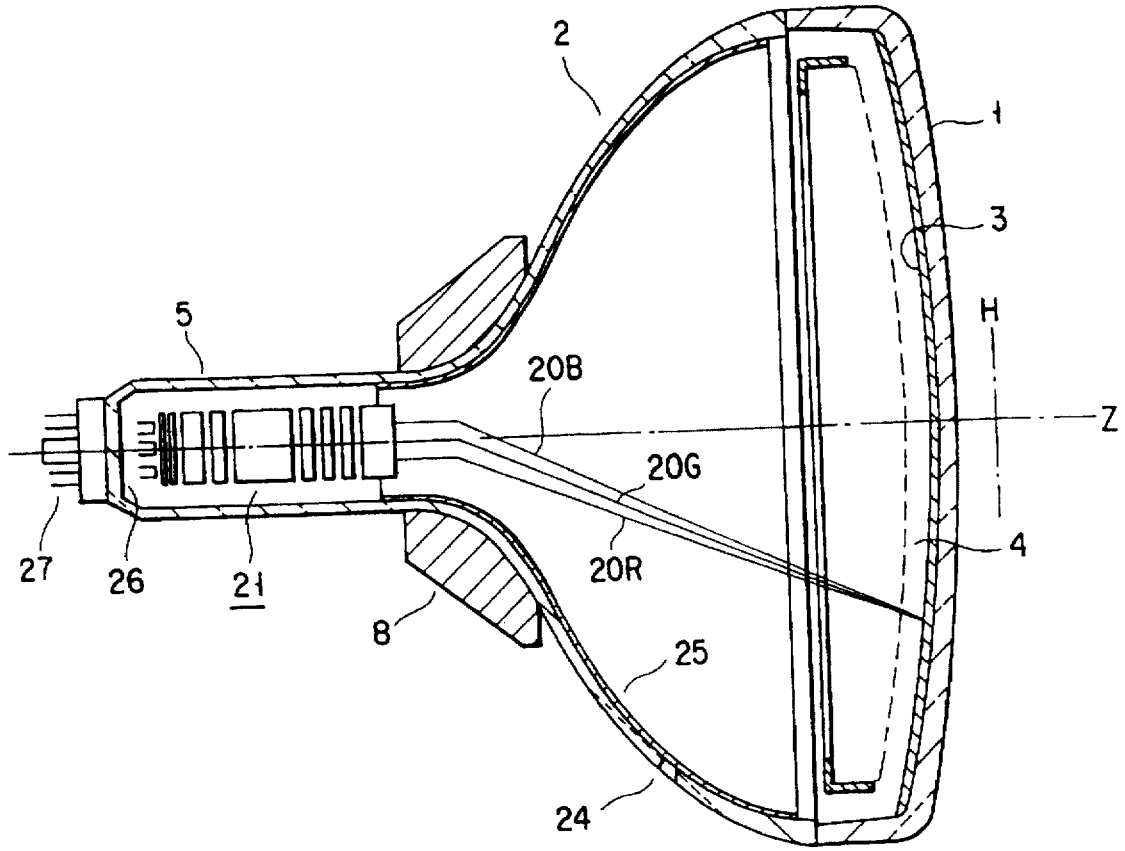
FIG. 6 is a sectional view schematically showing an arrangement of a color cathode ray tube apparatus according to an embodiment of the present invention.

FIG. 6 shows a color cathode ray tube apparatus according to an embodiment of the present invention. This apparatus comprises an envelope which is composed of a panel 1 and a funnel 2 bonded integrally to the panel. Formed on the inner surface of the panel 1 is a phosphor screen 3, composed of three stripe-shaped phosphor layers of different colors which emit blue, green, and red light beams. A shadow mask 4, having a number of electron beam holes therein, is attached to the inside of the phosphor screen 3 so as to face it. Located in a neck 5 of the funnel 2 is an electron gun assembly 21 for emitting three in-line electron beams 20B, 20G and 20R which pass along one horizontal plane. Also, a resistor (not shown) is arranged along one side of the gun assembly 21. A deflection yoke 8 is attached to the outside of the funnel 2. The electron beams 20B, 20G and 20R emitted from the electron gun assembly 21 are deflected by means of horizontal and vertical deflecting magnetic fields which are generated from the deflection yoke 8, and the phosphor screen 3 is scanned horizontally and vertically through the shadow mask 4. By doing this, a color image is displayed on the screen 3.

Figure 7A:
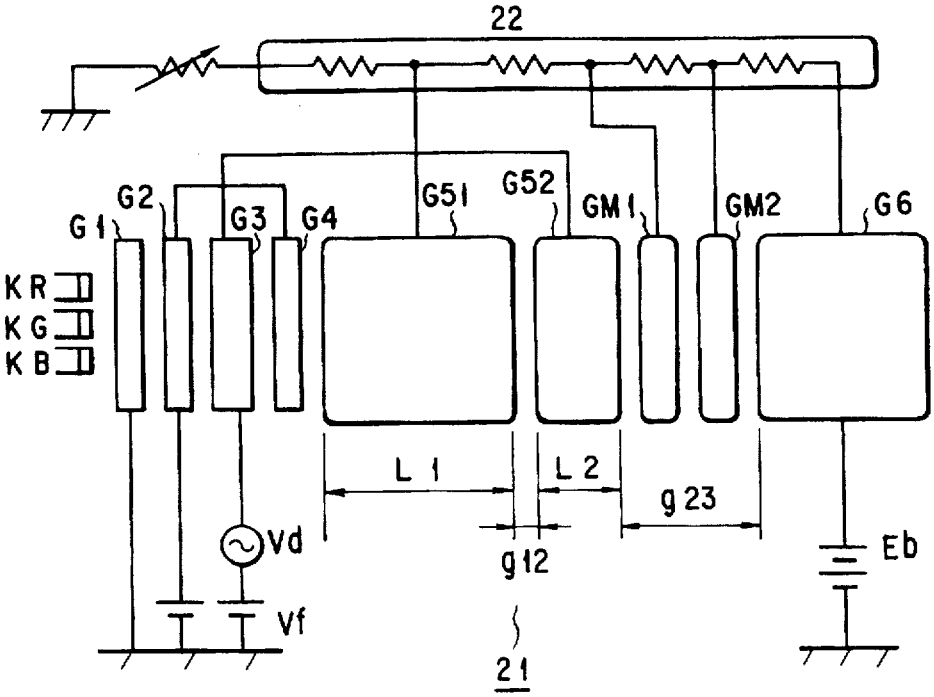
FIGS. 7A to 7E are a diagram showing a configuration of an electron gun assembly shown in FIG. 6 and plane views of electrodes incorporated in the electron gun assembly shown in FIG. 6.

As shown in FIG. 7A, the electron gun assembly 21 includes three cathodes KB, KG and KR arranged horizontally in a line, heaters (not shown) for individually heating the cathodes KB, KG and KR, and first to fourth grids G1 to G4 successively arranged at regular intervals from the cathodes KB, KG and KR toward the phosphor screen. The gun assembly 21 further includes bisected fifth grids G51 and G52 for use as first and second electrodes, respectively, two intermediate electrodes GM1 and GM2, and a sixth grid G6 for use as a third electrode. In FIG. 7A, numeral 22 denotes the resistor which is located on one side of the electron gun assembly.

The first and second grids G1 and G2 are formed of sheetlike electrodes, the third and fourth grids G3 and G4, bisected fifth grids G51 and G52, and sixth grid G6 are formed of tubular electrodes, and the two intermediate electrodes GM1 and GM2 are formed of thick plate electrodes, individually.

Figure 7B:
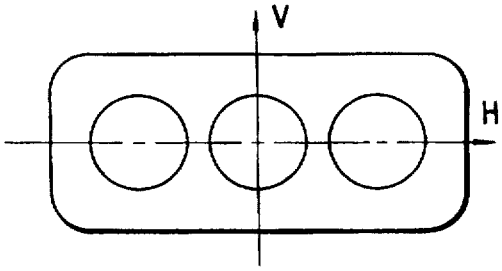
Figure 7C:
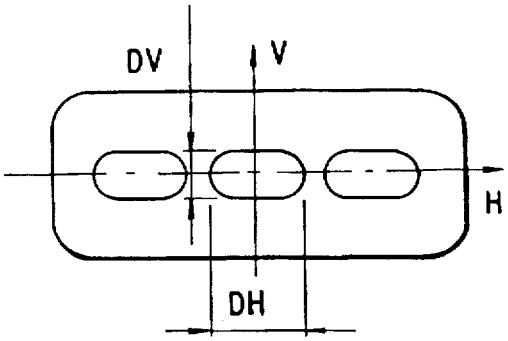
Figure 7D:
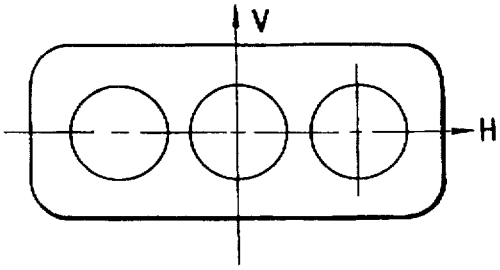
Figure 7E:
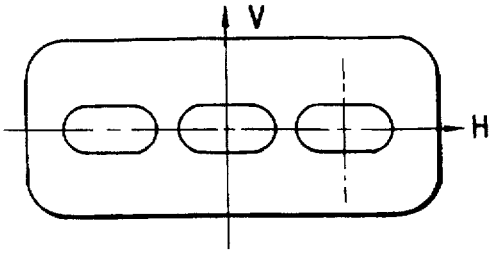

Corresponding individually to the three cathodes KB, KG and KR, three circular electron beam holes are formed in a line in each of the first, second, third, and fourth grids G1, G2, G3 and G4 and the fifth grid G51, as shown in FIG. 7B. Corresponding individually to the three cathodes KB, KG and KR, three substantially rectangular electron beam holes, having their longer sides extending in the horizontal direction or H-axis direction (H), are formed in a line in those portions of the fifth grid G52 on the sides of the fifth grid G51 and the intermediate electrode GM1, as shown in FIG. 7C. Corresponding individually to the three cathodes KB, KG and KR, three substantially circular electron beam holes are formed in a line in each of the two intermediate electrodes GM1 and GM2, as shown in FIG. 7D. Corresponding individually to the three cathodes KB, KG and KR, three substantially rectangular electron beam holes, having their longer sides extending in the horizontal direction, are formed in a line in that portion of the sixth grid G6 on the side of the intermediate electrode GM2, as shown in FIG. 7E.

In this electron gun assembly, the second and fourth grids G2 and G4 and the third and fifth grids G3 and G52 are connected to one another in a tube. A high anode voltage Eb is applied to the sixth grid G6 through an anode terminal 24 on a large-diameter portion of the funnel 2, an inside conductive film 25 formed on the inner surface of the funnel 2 by coating, as shown in FIG. 6, and the like. Predetermined voltages obtained by dividing the voltage Eb by means of the resistor 22 are applied individually to the fifth grid G51 and the two intermediate electrodes GM1 and GM2. Also, a dynamic-focus voltage Vd, which varies depending on the deflection of the electron beams, is applied to the third and fifth grids G3 and G52, which are connected in the tube, through stem pins 27 which airtightly penetrate a stem 26 for sealing the end portion of the neck 5. Moreover, predetermined voltages (mentioned in detail later) are applied individually to the cathodes KB, KG and KR and the first and second grids G1 and G2 through the stem pins 27 which airtightly penetrate the stem 26.

As the voltages are applied in this manner, in the electron gun assembly 21, the cathodes KB, KG and KR and the first, second, and third grids G1, G2 and G3 constitute an electron beam forming unit which controls emission of electrons from the cathodes KB, KG and KR and converges the emitted electrons into electron beams. The fifth grids G51 and G52, intermediate electrodes GM1 and GM2, and the sixth grid G6 constitute a main electron lens unit for focusing the electron beams from the electron beam forming unit onto the phosphor screen 3.

Figure 8:
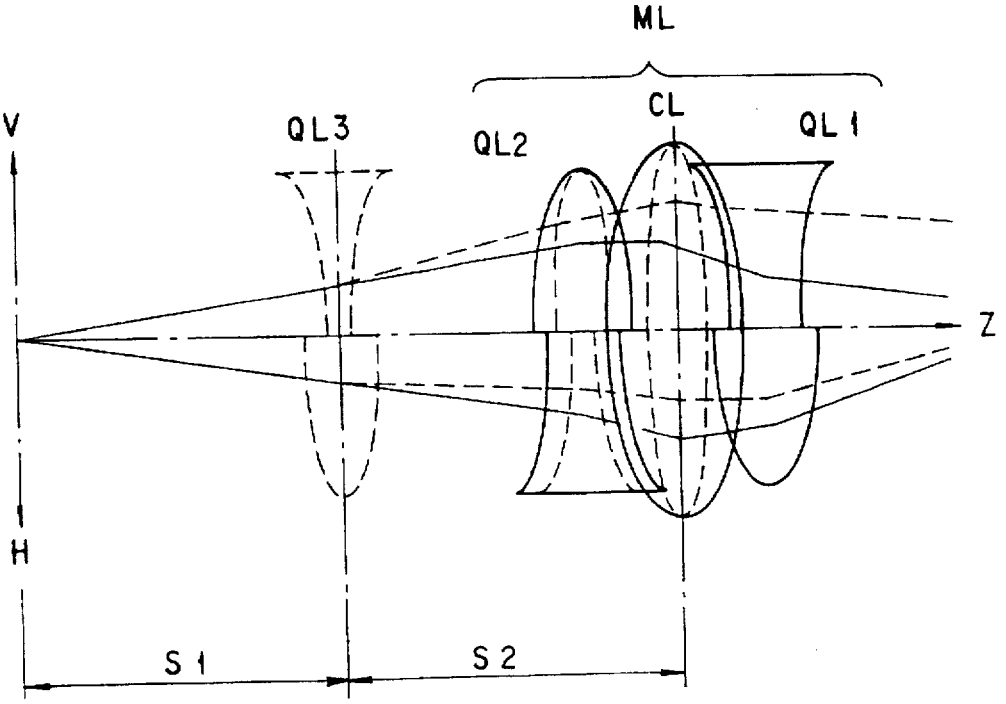
FIG. 8 is a diagram showing electron lenses formed in a main electron lens unit of the electron gun assembly shown in FIG. 7.
Figure 9:
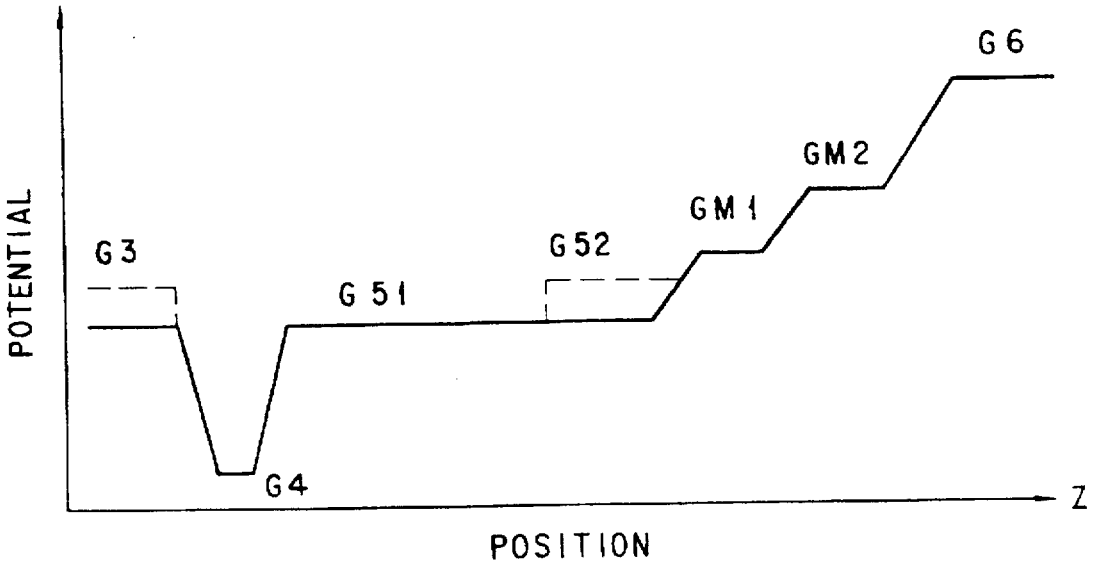
FIG. 9 is a diagram showing voltages applied individually to electrodes of the electron gun assembly shown in FIG. 7.

As shown in FIG. 8, the main electron lens unit includes a large-sized first electron lens ML and a second electron lens QL3 formed of a quadruple lens. The first electron lens ML is formed focusing the fifth grid G52, two intermediate electrodes GM1 and GM2, and sixth grid G6. As the three electron beams are deflected from the central portion of a picture toward the peripheral portion thereof, the dynamic-focus voltage Vd applied to the fifth grid G52 changes from the level indicated by solid line to the level indicated by broken line, as shown in FIG. 9. With this change, the quadruple second electron lens QL3 is formed between the fifth grids G51 and G52. The lens QL3 has effects of focus in the horizontal direction (H) and divergence in the vertical direction (V), as shown in FIG. 8. In the first electron lens ML, a quadruple lens QL2, which has effects of divergence in the horizontal direction (H) and focusing in the vertical direction (V), is formed between the fifth grid G52 and the intermediate electrode GM1 on the cathode side and a cylindrical lens CL is formed between the intermediate electrodes GM1, GM2. Also, a quadruple lens QL1, which has effects of focusing in the horizontal direction (H) and divergence in the vertical direction (V), is formed between the intermediate electrode GM2 and the sixth grid G6 on the screen side.

With use of the electron lenses QL2, CL and QL1 formed in the main electron lens unit, the fifth grids G51 and G52 are kept at substantially equal potentials or at potentials of several hundreds of volts, so that the effect of the second electron lens QL3 formed between these grids G51 and G52 is very small. Moreover, the electron beams 20B, 20G and 20R emitted substantially from the electron beam forming unit are focused by means of the first electron lens ML, as indicated by solid lines in FIG. 8, and reaches the phosphor screen. In the case where the electron beams 20B, 20G and 20R are deflected toward the peripheral portion of the picture, on the other hand, the dynamic-focus voltage Vd applied to the fifth grid G52 is raised in response to the deflection, and the second electron lens QL3, which has the effects of focusing in the horizontal direction (H) and divergence in the vertical direction (V), is formed having power corresponding to the change of the dynamic-focus voltage vd between the fifth grids G51 and G52. At the same time, the combined lens power of the quadruple lens QL2 and the cylindrical lens CL which are formed between the fifth grid G52 and the intermediate electrode GM1 and between the intermediate electrodes GM1, GM2 and has the effects of divergence and convergence in the horizontal and vertical directions, respectively, is lowered. In consequence, a lens which has substantial effects of converging and diverging the electron beams in the horizontal and vertical directions, respectively, as indicated by broken lines in FIG. 8, is relatively formed ranging from the fifth grid G51 to the intermediate electrode GM1.

Figure 1:
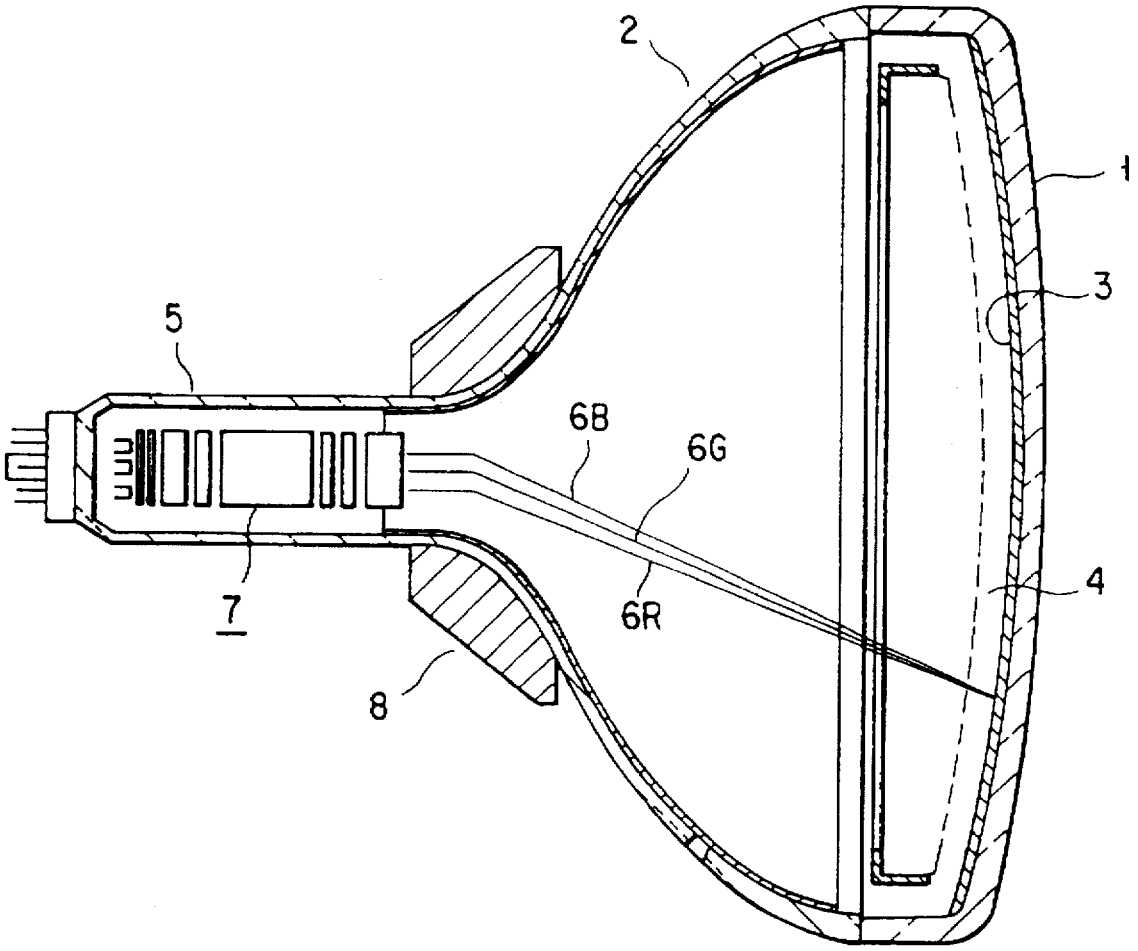
FIG. 1 is a sectional view schematically showing an arrangement of a conventional color cathode ray tube apparatus.
Figure 2A:
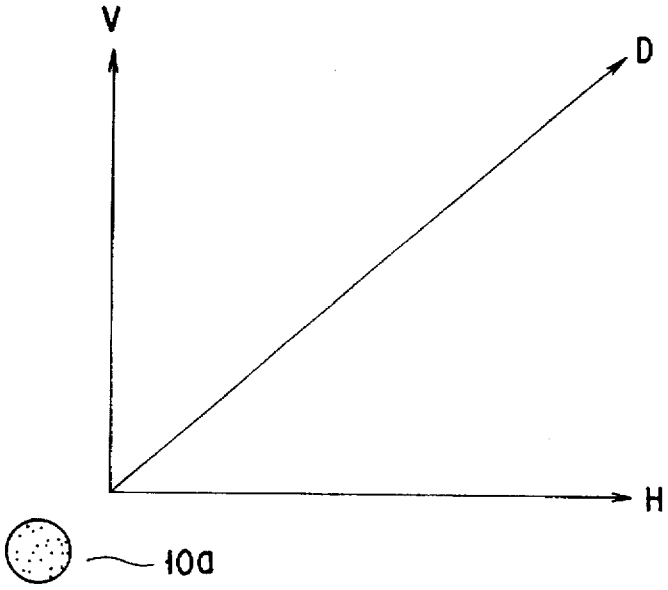
FIGS. 2A, 2B, 2C, 2D, 2E, 2F and 2G are plan views showing coordinate axes on a screen and the shapes of beam spots formed at the peripheral portion of a picture associated with the coordinate axes in a color cathode ray tube apparatus according to the present invention, compared with the shapes of beam spots formed at the peripheral portion of a picture associated with the coordinate axes in the conventional color cathode ray tube apparatus.
Figure 2B:
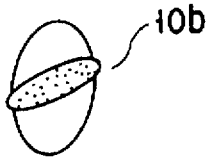
Figure 2D:
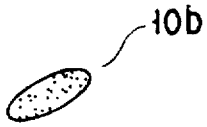
Figure 2F:
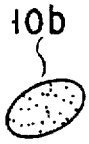
Figure 2C:
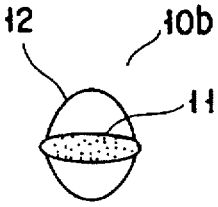
Figure 2E:
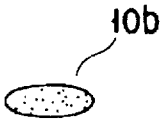
Figure 2G:
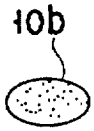
Figure 3A:
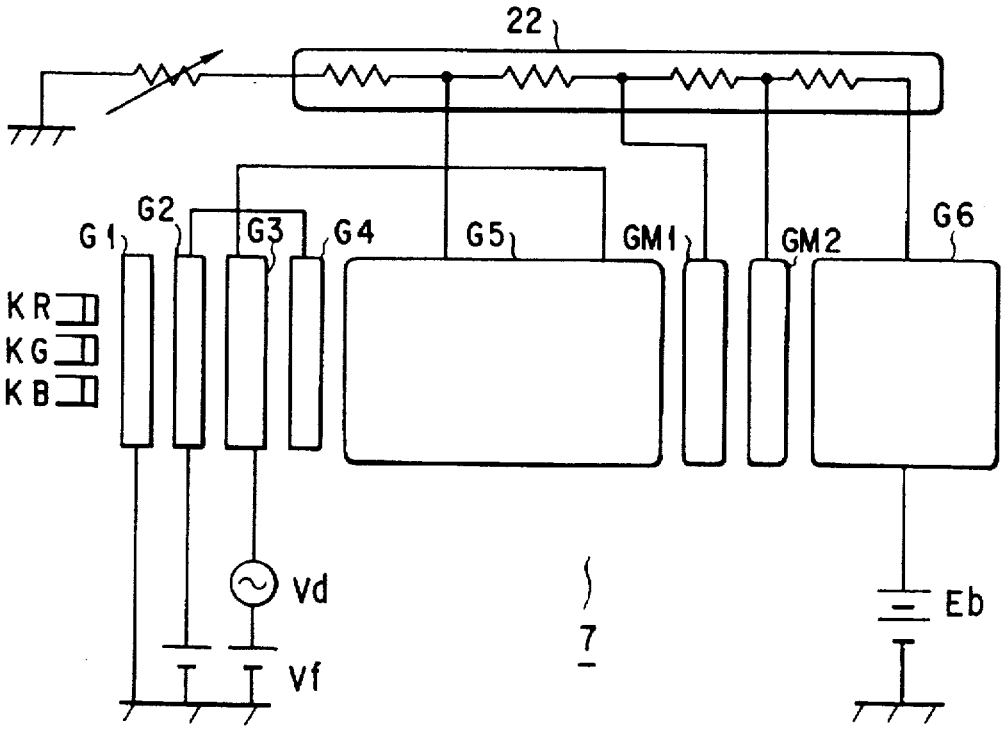
FIGS. 3A to 3D are a diagram showing a configuration of an electron gun assembly shown in FIG. 1 and plane views of electrodes incorporated in the electron gun assembly shown in FIG. 1.
Figure 3B:
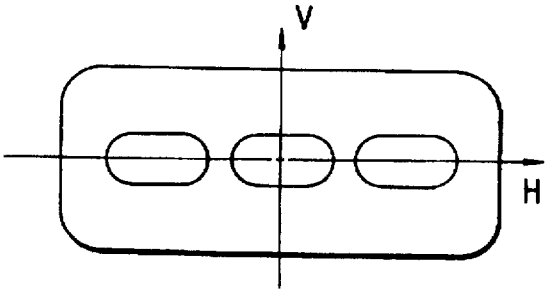
Figure 3C:
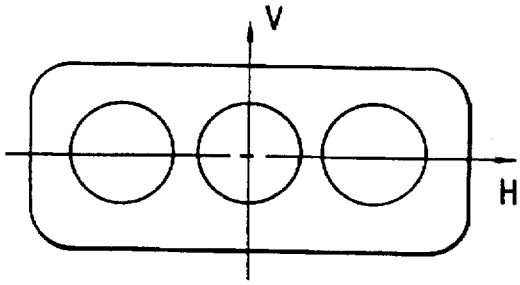
Figure 3D:
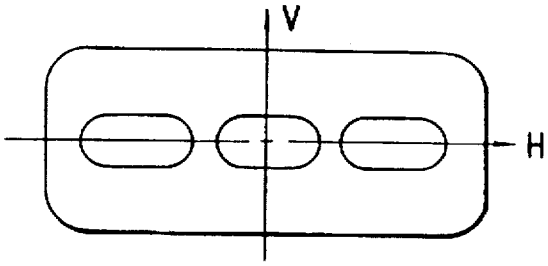
Figure 4:
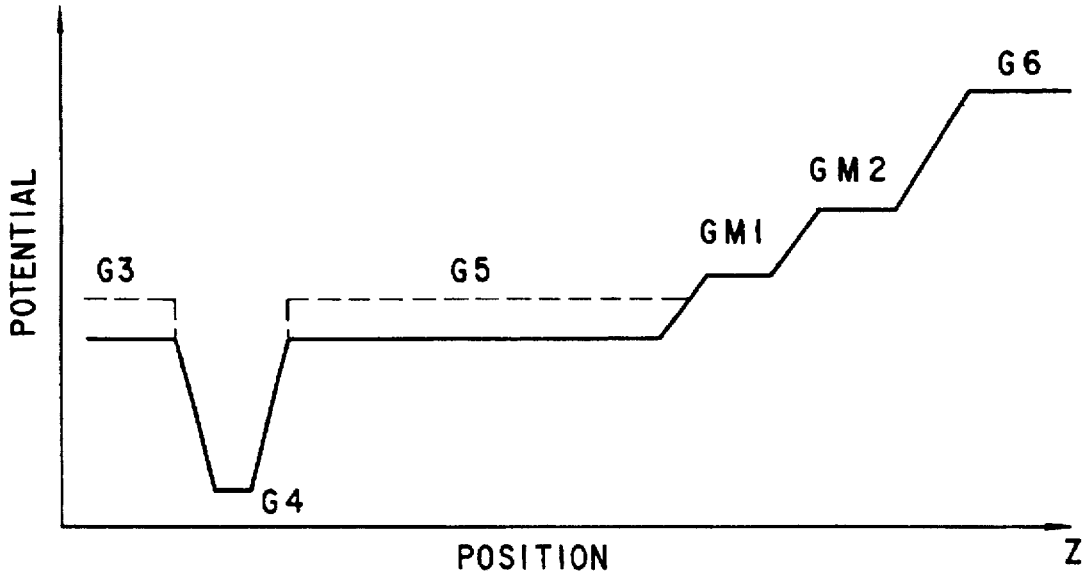
FIG. 4 is a diagram showing voltages applied individually to electrodes of the electron gun assembly shown in FIG. 3.
Figure 5A:
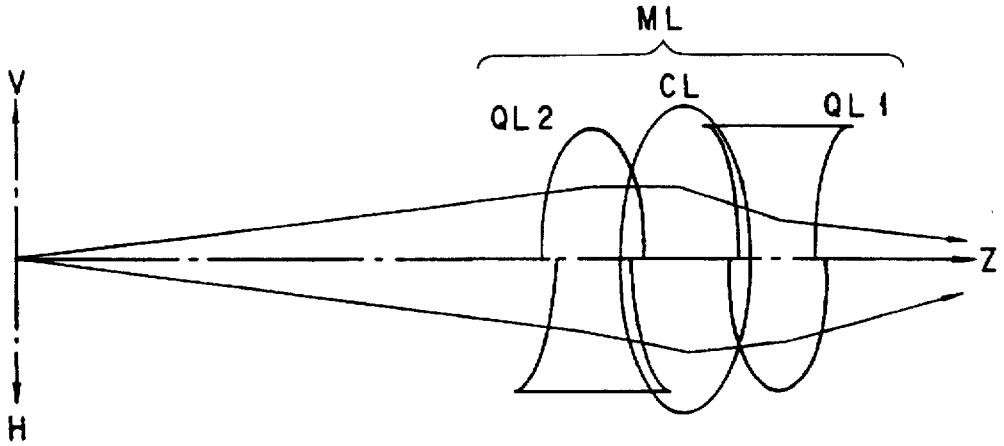
FIGS. 5A and 5B are diagrams showing electron lenses formed in a main electron lens unit of the electron gun assembly shown in FIG. 3 when the voltages shown in FIG. 4 are applied.
Figure 5B:
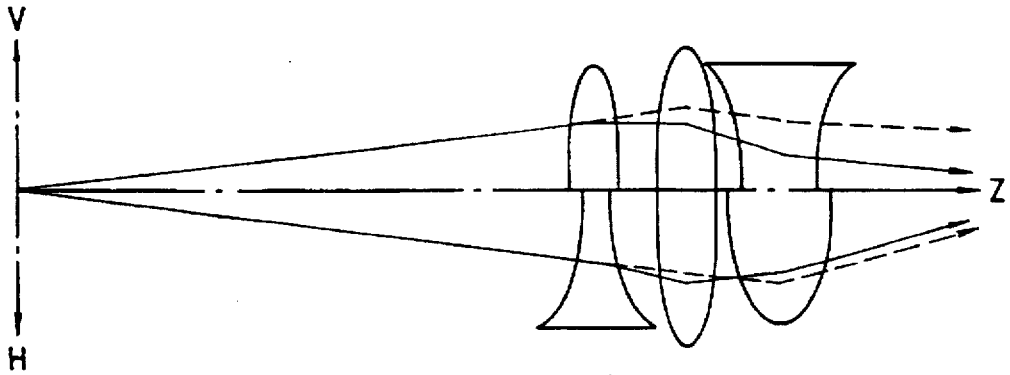

Thus, if the fifth grid is divided in two so that the dynamic-focus voltage vd can be applied to the other fifth grid G52 which faces the intermediate electrode GM1, the electron lens QL3, which has the effects of focusing in the horizontal direction (H) and divergence in the vertical direction (V), depending on the deflection of the electron beams, can be additionally formed by only changing the potential of one of the electrodes. With the additional use of this electron lens QL3, the electron beams are caused to focus and diverge in two stages. Conventionally, in contrast with this, the electron beams are subjected to the effects of horizontal focusing and vertical divergence in one stage by means of the one electrode. Thus, according to the present embodiment, the dynamic-focus sensitivity is improved, and a deflective distortion at the peripheral portion of the picture can be corrected by means of a low dynamic-focus voltage. Since the quadruple lens QL3 is located on the cathode side of the first electron lens ML which is formed between the fifth and sixth grids G52 and G6, moreover, the electron beams 20B, 20G and 20R can be constricted in the horizontal direction before they land on the lens ML. Thereupon, the horizontal diameter of each electron beam deflected toward the peripheral portion of the picture is reduced when the beams pass the deflecting magnetic fields, thus causing an excessively focused state. As a result, the electron beams can be corrected while reducing the influences of the effect of horizontal divergence of the deflecting magnetic fields. Since the electron beams are narrow with respect to the horizontal direction when they are focused on the phosphor screen 3, furthermore, a horizontally elongated geometrical distortion of the electron beams, obliquely incident upon the screen 3, can be corrected. Consequently, the horizontal diameter of each beam spot 10*b* at the peripheral portion of the picture can be made small, as shown in FIGS. 2D and 2E.

In the electron gun assembly of this type, the distance between the first and second electron lenses ML and QL3 is an important factor. As the electron beams are deflected, the second electron lens QL3 is caused to focus the electron beams in the horizontal direction and diverge them in the vertical direction. Thereupon, the geometrical distortion of the electron beams at the peripheral portion of the phosphor screen 3 is corrected by the effect of horizontal focusing, and deflective aberration is corrected by the effect of divergence. In correcting the geometrical distortion, it is more effective to locate the second electron lens QL3 in the position nearer to the cathodes KB, KG and KR, where the beam diameter is relatively small, since the electron beams can be converged to a smaller diameter. In correcting the deflective distortion, it is advisable to locate the second electron lens QL3 nearer to the first electron lens ML or to the deflection yoke, since the object position as viewed from the equivalent quadruple lens in the deflecting magnetic fields at the time of correction is shifted closer to the quadruple lens.

If the first and second electron lenses ML and QL3 are located too close to each other, an electric field penetrating through the horizontally elongated electron beam holes of the cathode-side second electrode G52, which constitutes the first electron lens ML, penetrates into the first electrode G51 which has the circular electron beam holes and constitutes the second electron lens QL3. Thereupon, the quadruple lens component to be formed on the cathode side of the first electron lens ML is weakened, and the dynamic-focus sensitivity is lowered, so that the effects of the present invention cannot be enjoyed satisfactorily. Thus, the first electrode G51 must be situated in a position such that it exerts no influence upon the electric field of the first electron lens ML.

In the case of an electron lens system with a noncircular aperture, the electric field never penetrates for a distance equal to the maximum aperture diameter. In the case of a cylindrical electron lens system, however, the electric field penetrates toward the axis of symmetry for a distance substantially equal to the aperture diameter. It is believed, therefore, that the electric field penetrates for a distance not shorter than the minimum aperture. Supposedly, however, the substantial lens effect region in the penetrative electric field depends on about 70 to 80% of the penetrative electric field distance.

Thus, if the horizontal and vertical diameters of the horizontally elongated electron beam holes on that side of the second electrode G52 nearer to the third electrode G6 are DH and DV, respectively, as shown in FIG. 7C, the distance of the penetrative electric field from the second electrode G52 can be estimated at a value substantially intermediate between DH and DV, that is, (DH+DV)/2. If the sum of the length L2 of the second electrode G52 and the distance g12 between the first and second electrodes G51 and G52, as shown in FIG. 7A, is adjusted to 0.8(DH+DV)/2 or more, therefore, the electric field penetrating from the second electrode G52 to the cathode side can be supposed not to be influenced by the first electrode. Thus, it is necessary only to meet the following condition:

$$0.8(DH+DV)/2 \leqq L2+g12.$$

If the distance between the first and second electron lenses ML and QL3 is too long, on the other hand, the electron beams diverged in the vertical direction by means of the second electron lens QL3 pass through a separate-axis portion of the first electron lens ML, so that they are focused under the influence of the spherical aberration of the lens ML. Thus, a satisfactory effect of divergence cannot be obtained. If the first and second electron lenses ML and QL3 are located at an extremely long distance from each other, the electron beams may run against the electrodes which constitute the first electron lens ML, in some cases. Accordingly, the second electron lens QL3 must be situated in a position such that it is not influenced by the spherical aberration of the first electron lens ML.

In general, an electron lens is designed so that its spherical aberration is relatively small in the region covering about 15% or less of the aperture diameter D from the central axis of an electron beam hole of an electrode which constitutes the lens. Outside the region covering 25% of the aperture diameter D, the spherical aberration increases drastically, so that the electron beam is focused with a beam coverage not higher than 15% of the aperture diameter D.

If the distances from the electron beam forming unit to the second electron lens QL3 and from the lens QL3 to the first electron lens ML are S1 and S2, respectively, the divergence angle α of the electron beams incident upon the first electron lens ML is about 1.5°. If the beam coverage of the first electron lens ML is 15%, therefore, we have $$(S1+S2)\cdot\tan 1.5°=0.15\cdot D$$

so that the electron beams diverge at an angle of about 2.5° in the second electron lens QL3. If the beam coverage of the first electron lens ML is 25% or less, at this time, we have $$S1\cdot\tan 1.5°+S2\cdot\tan 2.5° \leqq 0.25\cdot D$$

Accordingly, we obtain $$S2 \leqq 5.7D.$$

When the center of each lens is situated halfway between the electrodes, and if the distances between the first and second electrodes G51 and G52 and between the second and third electrodes G52 and G6 and the lengths of the second electrode G52 are g12, g23 and L2, respectively, there is a relation, $$S2=L2+(g12+g23)/2,$$

If there is a relation, $$L2+(g12+g23)/2<5.7\cdot D,$$

therefore, the influence of the spherical aberration is very small.

Referring now to FIGS. 7A, 7B, 7C, 7D, and 7E, a preferred specific example of the present invention will be described.

Three circular electron beam holes with a diameter of 0.3 to 1.0 mm are formed in the first and second grids G1 and G2, corresponding individually to the cathodes KB, KG and KR. Three circular electron beam holes with a diameter of 1.0 to 3.0 mm are formed in that portion of the third grid G3 on the side of the second grid G2. Three circular electron beam holes with a diameter of 5.5 mm are formed in that portion of the third grid G3 on the side of the fourth grid G4 and in the fourth and fifth grids G4 and G5. Three substantially rectangular electron beam holes with vertical and horizontal diameters of 4.7 mm and 6.2 mm, respectively, are formed in that portion of the fifth grid G52 on the side of the fifth grid G51. Three substantially rectangular electron beam holes with vertical and horizontal diameters of 4.7 mm and 6.2 mm, respectively, are formed in that portion of the fifth grid G52 on the side of the intermediate electrode GM1. Three substantially circular electron beam holes with a diameter of 6.2 mm are formed in the intermediate electrodes GM1 and GM2. Three substantially rectangular electron beam holes with vertical and horizontal diameters of 4.7 mm and 6.2 mm, respectively, are formed in that portion of the sixth grid G6 on the side of the intermediate electrode GM2. Two horizontally elongated metal pieces are attached to the inside of each of the fifth and sixth grids G52 and G6 so as to sandwich the three electron beams between them. Moreover, the lengths G3L, G4L, G51L, G52L, GM1L, GM2L and G6L of the third grid G3, fourth grid G4, fifth grids G51 and G52, intermediate electrodes GM1 and GM2, and sixth grid G6 are 3.1 mm, 2.0 mm, 20.3 mm, 4.8 mm, 2.0 mm, 2.0 mm, and 8.6 mm, respectively. The distances g34, g451, g5152, g52M1, gM1M2 and gM26 between the third and fourth grids G3 and G4, between the fourth and fifth grids G4 and G51, between the fifth grids G51 and G52, between the fifth grid G52 and the intermediate electrode GM1, between the intermediate electrodes GM1 and GM2, and between the intermediate electrode GM2 and the sixth grid G6 are 0.7 mm, 0.7 mm, 0.5 mm, 0.8 mm, 0.8 mm, and 0.8 mm, respectively.

Voltages obtained by superposing a video signal on cut-off voltages of 100 to 200 volts are applied to the cathodes KB, KG and KR. Voltages of 600 to 1,000 volts are applied to the second and fourth grids G2 and G4 with the first grid G1 at the ground potential, and voltages equal to 20 to 40% of the anode voltage Eb are applied to the third and fifth grids G3 and G52 through the stem pins, individually. The voltages obtained by dividing the anode voltage by means of the resistor located beside the electron gun assembly in the tube are applied individually to the fifth grid G51 and the intermediate electrodes GM1 and GM2. More specifically, a voltage substantially equal to the one applied to the third grid G3 is applied to the fifth grid G51, a voltage equal to 30 to 50% of the anode voltage to the intermediate electrode GM1, and a voltage equal to 60 to 80% of the anode voltage to the intermediate electrode GM2. Also, superposed voltages of 500 to 1,500 Vp - p are applied to the third and fifth grids G3 and G52 in synchronism with the deflection of the electron beams.

In this case, the first, second, and third electrodes correspond to the fifth grids G51 and G52 and the sixth grid G6, respectively. Accordingly, the horizontal and vertical aperture diameters DH and DV of the fifth grid G52 on the side of the intermediate electrode GM1 are 6.2 mm and 4.7 mm, respectively, the electrode length L2 or L52 is 4.8 mm, and the interelectrode distance g12 is 0.5 mm. Thus, we obtain $$0.8(DH+DV)/2=0.8(6.2+4.7)/2=4.36(\text{mm}).$$

On the other hand, we have $$L2+g12=5.3\ (\text{mm}),$$

so that the aforementioned condition is satisfied, and the electric field penetrating into the fifth grid G52 cannot be influenced by the fifth grid G51. Thus, the sensitivity for the correction of the deflective aberration never lowers.

Since the vertical diameter of the first electron lens ML is DV, the vertical spherical aberration of the lens ML is substantially associated with DV. Accordingly, the aperture diameter D or DV is 4.7 mm, L2 is 4.8 mm, g12 is 0.5 mm, and g23, which is practically equal to the distance between the fifth grid G52 and the sixth grid G6, is 6.4 mm. Thus, we obtain $$5.7D=5.7\times4.7=26.8\ (\text{mm}).$$

On the other hand, we have $$\begin{aligned} L2+(g12+g23) &= 4.8+(0.5+6.4)/2 \\ &= 8.25\ (\text{mm}), \end{aligned}$$

so that the aforementioned condition is satisfied, and the spherical aberration of the first electron lens exerts no influence. Thus, the sensitivity for the correction of the deflective aberration never lowers.

According to an alternative embodiment, the vertical diameter of the three electron beam holes in that portion of the fifth grid G51 on the side of the fifth grid G52 may be made greater than their horizontal diameter so that they have a substantially rectangular shape with its longer side extending in the vertical direction. With this arrangement, the effect of the electron gun assembly can be further improved by enhancing the quadruple lens effect of the second electron lens.

According to the embodiments described above, the first electron lens of the electron gun assembly is of the extended electric field type, including the quadruple lens composed of the second and third electrodes and the intermediate electrodes interposed between them. However, the present invention is not limited to this arrangement, and may be also applied to any other electron gun assembly which combines quadruple lenses and other electron lenses and uses the quadruple lens unit as its first electron lens. In this case, for example, the electron lens system may include a quadruple lens component in the cathode side, or a combination of a quadruple lens and a BPF (bi-potential focus) electron lens may be used as the first electron lens.

According to the present invention, the effects of the first electron lens are attenuated, and the asymmetric second electron lens is caused to act, depending on the deflection of the electron beams. Thus, the electron beams are diverged in the vertical direction in two stages by means of the first and second electron lenses, whereby excessive convergence caused by the deflecting magnetic fields is corrected. At the same time, the electron beams are converged or constricted in the horizontal direction before they land on the first electron lens, whereby the electron beams passing through the deflecting magnetic fields are excessively converged to have a small horizontal diameter. By doing this, the effect of divergence of the deflecting magnetic fields and the geometrical distortion of the electron beams, obliquely incident upon the screen, can be corrected. By supplying the second electrode with a voltage which varies depending on the deflection of the electron beams, moreover, it is possible to provide two electron lenses which substantially have effects of convergence and divergence in the horizontal and vertical directions, respectively. Thus, in contrast with the conventional case where only one electrode is used in one stage to produce the effects of convergence and divergence in the horizontal and vertical directions, respectively, the distortion of the beam spots at the peripheral portion of the picture can be corrected with use of a low dynamic-focus voltage. Accordingly, a high-resolution color cathode ray tube apparatus can be obtained enjoying an improved dynamic-focus sensitivity and small beam spot diameters throughout the picture.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A color cathode ray tube apparatus comprising:

a phosphor screen;

an electron gun assembly including:

an electron beam generator formed of an electrode structure having cathodes and generating three in-line electron beams, and including first, second, and third electrodes successively arranged from a cathode side toward the phosphor screen which allow the passage of the electron beams from the electron beam generator so that the electron beams are focused on the phosphor screen;

a deflection yoke for causing a deflection of the electron beams from the electron gun assembly in horizontal and vertical directions; and voltage applying means for applying a constant intermediate voltage to the first electrode, a dynamic-focus voltage to the second electrode, which is increased from a level substantially the same as that of the intermediate voltage depending on the deflection of the electron beams, and a constant high voltage to the third electrode, which has a level higher than the intermediate voltage, thereby forming an electron lens system including:

a first electron lens formed between the second and third electrodes including at least a first asymmetric lens which diverges and converges the electron beams in the horizontal and vertical directions, respectively, and which is formed in a lens effect region of the first electron lens, the first asymmetric lens having a variable lens power to diverge and converge the electron beams which is enhanced when the beams are directed toward a center region of the phosphor screen and which is attenuated as the beams are deflected to peripheral regions of the phosphor screen, and a second asymmetric lens formed between the first and second electrodes which converges and diverges the electron beams in the horizontal and vertical directions, respectively, the second asymmetric lens having substantially no lens power to converge and diverge the electron beams when the electron beams are directed to the center region of the phosphor screen and increasing to predetermined lens powers in the horizontal and vertical directions, respectively, when the electron beams are deflected to the peripheral regions of the phosphor screen.

2. A color cathode ray tube apparatus according to claim 1, wherein an inequality holds true as follows:

$$0.8(DH+Dv)/2 \leqq L2+g12$$

where L2 is a length of the second electrode in an axial direction of the electron gun assembly, g12 is a distance between the first and second electrodes, DH is a horizontal direction dimension of apertures in the second electrode, and Dv is a vertical direction dimension of the apertures in the second electrode.

3. A color cathode ray tube apparatus according to claim 1, wherein an inequality holds true as follows:

$$L2+(g12+g23)/2<5.7D,$$

where L2 is a length of the second electrode in an axial direction of the electron gun assembly, g12 is a distance between the first and second electrodes, g23 is a distance between the second and third electrodes, and D is the lesser of a horizontal direction dimension and a vertical direction dimension of apertures in the second electrode.

4. A color cathode ray tube apparatus according to claim 1, wherein the electron gun assembly further includes first and second intermediate electrodes arranged between the second and third electrodes.

* * * * *